United States Patent [19]

Crafton

[11] Patent Number: 5,029,531

[45] Date of Patent: Jul. 9, 1991

[54] VERY HIGH SPEED GROUND TRANSPORTATION SYSTEM

[76] Inventor: Paul A. Crafton, 938 Schulze Dr., Norman, Okla. 73071

[21] Appl. No.: 443,004

[22] Filed: Nov. 29, 1989

[51] Int. Cl.[5] ..... B61B 13/00

[52] U.S. Cl. ..... 104/138.1; 105/365

[58] Field of Search ..... 104/138.1, 138.2; 105/365

[56] References Cited

U.S. PATENT DOCUMENTS

| | | | |
|---|---|---|---|
| 3,722,428 | 3/1973 | Alexandrov et al. | 104/138.1 |
| 3,734,428 | 5/1973 | Alexandrov et al. | 104/138.1 |
| 3,979,917 | 9/1976 | Crafton | 61/42 |
| 3,979,941 | 9/1976 | Auxer | 104/138.2 |
| 4,066,021 | 1/1978 | Helm | 104/138.1 |
| 4,113,202 | 9/1978 | Ueno | 104/138.1 |
| 4,576,097 | 3/1986 | Foster | 105/365 |
| 4,677,865 | 7/1987 | Lehmann | 104/138.2 |
| 4,722,001 | 1/1988 | Rohrich et al. | 104/138.2 |

FOREIGN PATENT DOCUMENTS

| | | | |
|---|---|---|---|
| 3725671 | 2/1979 | Fed. Rep. of Germany | 104/138.1 |
| 0105839 | 6/1983 | Japan | 104/138.2 |
| 0063467 | 3/1989 | Japan | 104/138.2 |
| 0280358 | 8/1970 | U.S.S.R. | 104/138.1 |

*Primary Examiner*—Robert J. Oberleitner
*Assistant Examiner*—Mark T. Le
*Attorney, Agent, or Firm*—Paul A. Crafton

[57] ABSTRACT

A system for very high speed ground transportation employing vehicles running in tunnels. The interior surface of the tunnels is a helical thread, and the wheels of the vehicle are helical gears meshing with the helical interior surface of the tunnel so as to provide positive traction. The vehicles have top traction wheels as well as bottom traction wheels in order to provide dynamic stability at very high vehicular speeds. Each vehicle carries an inner compartment coupled to the vehicle so that the compartment may be continually positioned relative to the vehicle in order to provide passenger comfort and/or cargo safety as the vehicle moves down the tunnel when the longitudinal axis of the tunnel has curvature.

7 Claims, 6 Drawing Sheets

VIEW A-A

VERY HIGH SPEED GROUND TRANSPORTATION SYSTEM

FIELD OF THE INVENTION

The present invention relates to very high speed vehicles running in tunnels, and more particularly to vehicles and tunnels with positive traction between the vehicles and the interior surface of the tunnel. The present invention also relates more particularly to vehicles with top traction wheels as well as bottom traction wheels so as to provide dynamic stability at very high vehicular speeds. The present invention also relates more particularly to a coupled compartment the positioning of which relative to the vehicle can be continually varied en route in order to provide passenger comfort and/or cargo safety.

BACKGROUND OF THE INVENTION

There are several existent transportation systems for high speed ground transportation of passengers and/or cargo, but all require essentially straight-line track because no provision is made for passenger comfort and/or cargo safety on curved track. Existing systems do not have positive mechanical traction between vehicles and track, and there are therefore limitations on the ascending and descending grades of the track. Furthermore, existing systems do not have vehicles mechanically tracked top and bottom, and therefore cannot ensure dynamic stability and thus passenger safety. Existing systems are limited to speeds of approximately 200 miles per hour even on essentially straight-line track, whereas the transportation system of the present invention should be able to have ground speeds of 500 miles per hour or more even on curved track while providing comfort and safety.

The vehicular tunnels of the present invention can be installed by the invention of U.S. Pat. No. 3,979,917 (Omnidirectional Drilling System) and by the invention disclosed in the patent application entitled OMNIDIRECTIONAL DRILLING SYSTEM WITH ROBOTIC INSTALLATION OF PREFABRICATED LININGS.

SUMMARY OF THE INVENTION

The present invention is directed to an improvement in high speed ground transportation so as to provide safety and comfort at very high speeds. Vehicles having helical traction wheels are tracked top and bottom in vehicular tunnels having helical interior surfaces so as to provide positive mechanical traction together with dynamic stability. The vehicles are able to position themselves in the tunnels so as to compensate for the curvature of the tunnels as they move at very high speeds. Additionally, passengers and/or cargo are carried in a separate compartment coupled to the vehicle, and the positioning of the compartment relative to the vehicle is able to be continually changed en route in order to further compensate for tunnel curvature so as to further enhance passenger comfort and cargo safety.

The vehicular tunnels of the present invention can be installed by the invention of U.S. Pat. No. 3,979,917 (Omnidirectional Drilling System) and by the invention disclosed in the patent application entitled OMNIDIRECTIONAL DRILLING SYSTEM WITH ROBOTIC INSTALLATION OF PREFABRICATED LININGS.

OBJECTS OF THE INVENTION

The principal objects of the present invention are: to provide an improved system for the very high speed ground transportation of passengers and/or cargo, to provide such a system with positive mechanical traction, to provide such a system with the vehicles tracked top and bottom in order that the vehicles be dynamically stable for passenger and cargo safety, and to provide such a system with the capability of the vehicle and its passenger/cargo compartments to furnish passenger comfort when the vehicle pursues a path with curvature. Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriately detailed structure and configuration.

Figure 1:
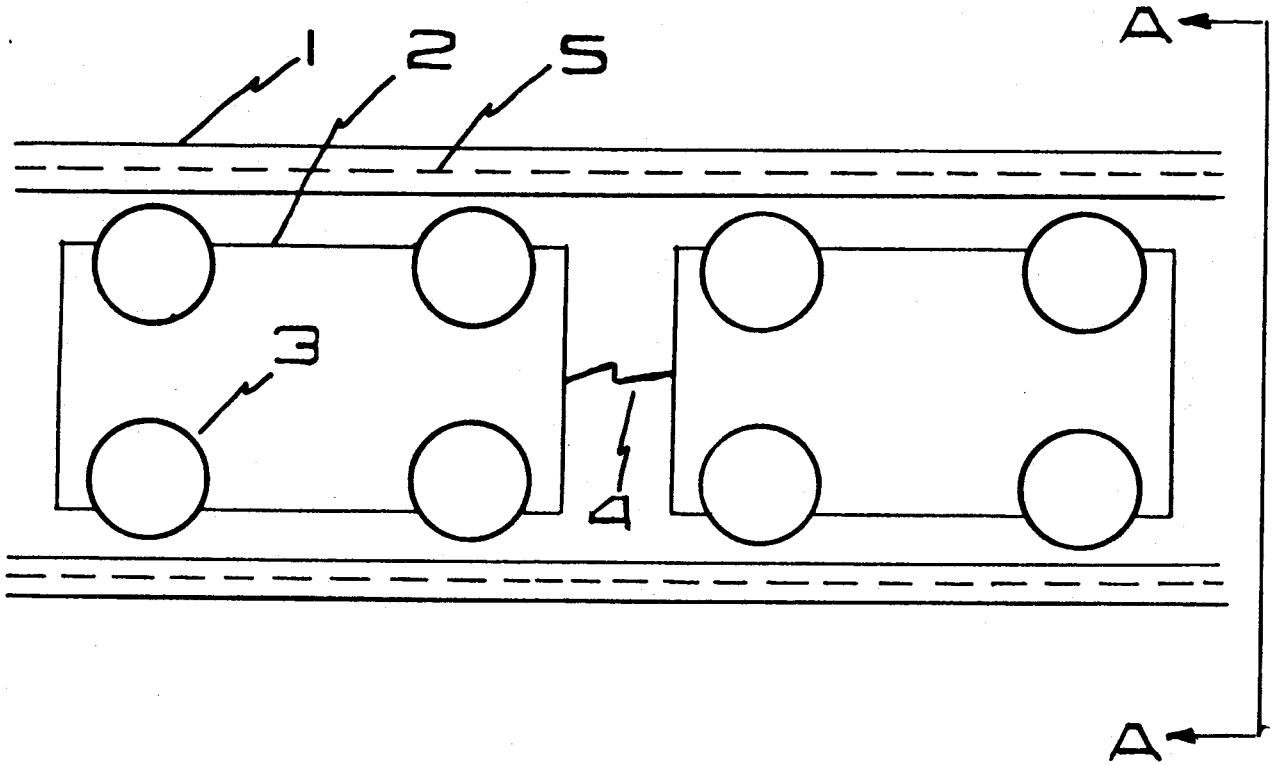
FIG. 1 shows a sequence of self-propelled vehicles in a tunnel connected only by a cable for communication and control, and tracked top and bottom.

In FIG. 1, self-propelled vehicles 2 are moving in tunnel 1 coupled to tunnel 1 by wheels 3 on top and bottom of each vehicle 2. Vehicles 2 are connected to each other only by cable 4 for the purposes of communication and control. Vehicles 2 can travel singly, or connected together in a train as shown in the drawing.

Figure 2:
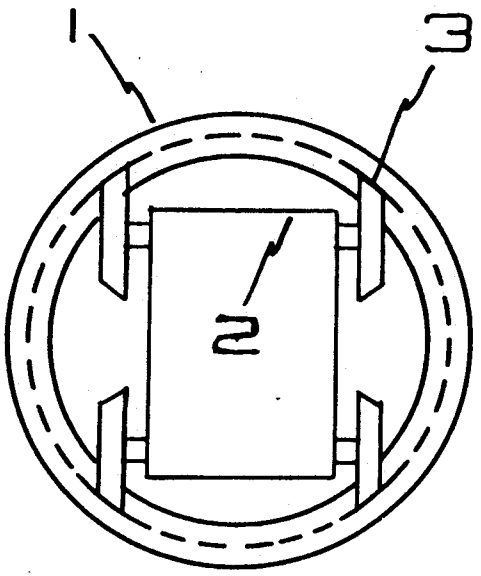
FIG. 2 is an orthogonal view of FIG. 1, and also shows the vehicles tracked top and bottom.

FIG. 2 is a cross-sectional view of tunnel 1 of circular cross-section, and shows vehicle 2 mounted top and bottom through independent traction wheels 3.

Figure 3:
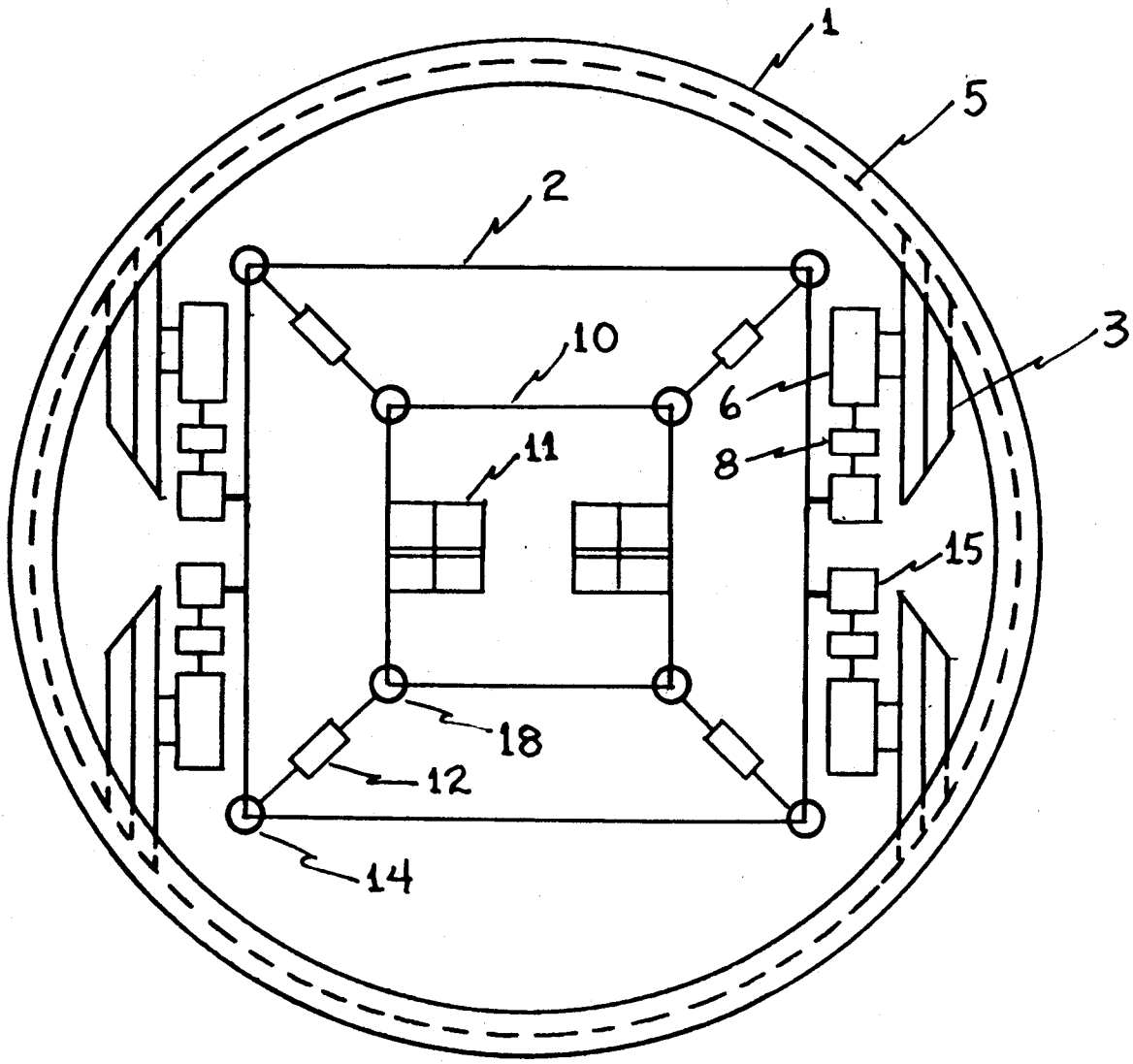
FIG. 3 is a cross-sectional view of the tunnel showing the vehicle tracked top and bottom, and also showing the passenger/cargo compartment coupled to the vehicular frame.
Figure 4:
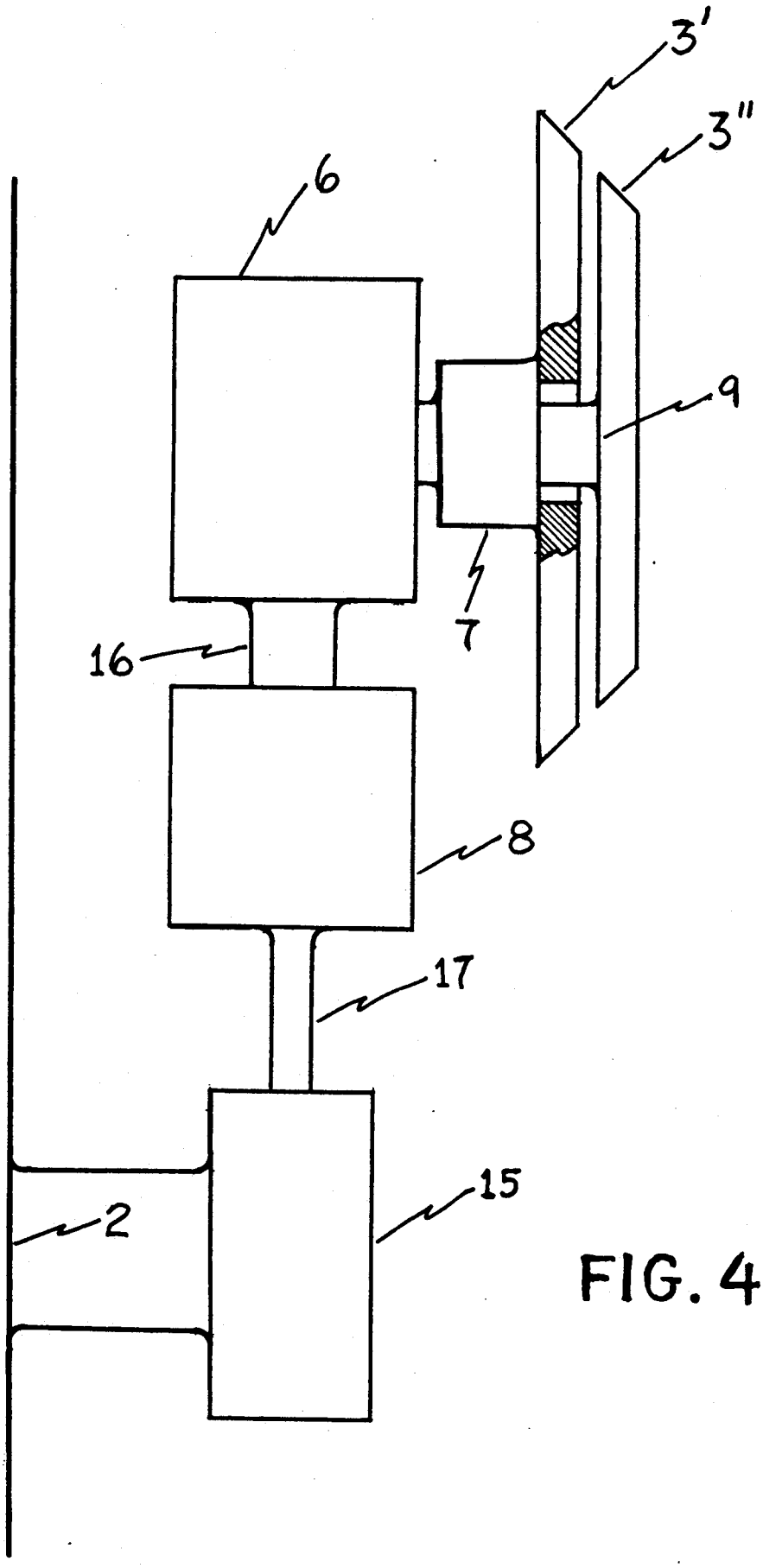
FIG. 4 shows the traction motor-wheel mechanism.

In FIG. 3, tunnel 1 has an interior helical threaded surface 5. Traction wheels 3 are helical gears meshing with the threaded surface 5. Each traction wheel 3 is split into two component helical-gear traction wheels 3' and 3'' rotating about the same axis of spin. As shown in FIG. 4, the housing of rotary motor 7 is mounted to and is kinematically part of the shaft of rotary motor 6; shaft 9 of rotary motor 7 is kinematically part of wheel 3", and rotates about its axis not continuously but only to adjust as required the rotational displacement of wheel 3" relative to concentric wheel 3'. The composite wheel 3, with component wheels 3' and 3" rotationally adjusted relative to each other by rotary motor 7, is driven by rotary motor 6.

Wheels 3' and 3" of each composite traction wheel 3 may be rotationally displaced relative to each other, about their common axis of spin, in order to enable wheel 3 to be a steerable wheel while still maintaining meshing contact with the helical interior surface of the tunnel. The gear-tooth profile of each wheel, 3' and 3", of composite traction wheel 3 is not sufficient in itself to properly maintain meshing contact with the helical surface of the tunnel. It requires the composite tooth profile of both parallel component wheels, 3' and 3", to maintain proper meshing contact. As the composite traction wheel set 3 rotates steerably, the two component wheels, 3' and 3", of composite traction wheel 3 have a relative rotational displacement about their common axis of spin in order to change the composite gear-tooth profile of composite traction wheel 3 in order to compensate for the steering rotational displacement.

Figure 5:
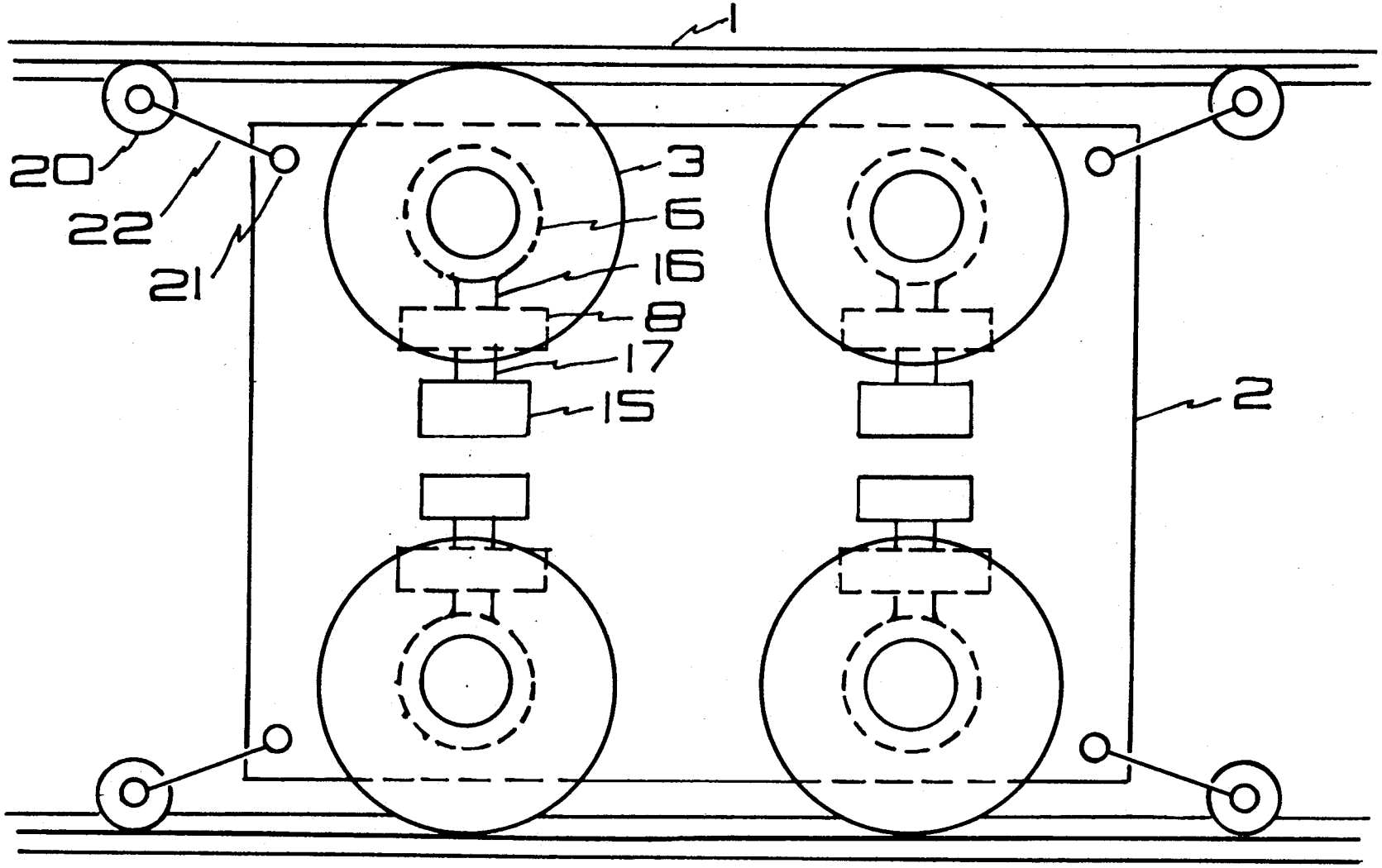
FIG. 5 is a longitudinal elevation view of a vehicle showing, the suspension mechanism for the vehicular frame.

Referring to FIGS. 3 and 4, the combination of rotary motor 6 and wheel 3 is rotated about the vertical axis of vehicle 2 by rotary motor 8 through shaft 16 in order to independently steer wheel 3 by rotating wheel 3 about a vertical axis. The housing of rotary motor 8 is kinematically part of rod 17, and rod 17 is the rod of linear motor 15. The housing of linear motor 15 is mounted to the frame of vehicle 2. Thus linear motor 15 provides the relative vertical motion between vehicle 2 and each of its traction wheels 3. Linear motors 15 are computer controlled so as to maintain the vehicle level. Any irregularities in the tunnel are detected by sensor wheels 18 (shown in FIG. 5) and linear motors 15 are activated accordingly by an appropriate feedback system of process control, as shown diagrammatically in FIG. 7. Also, computer controlled independent steering of traction wheels 3 will cause the vehicle to ride up the side of the tunnel so that the vector sum of the centrifugal force on vehicle 2, due to the curvature of the longitudinal axis of the tunnel, and of the weight vector of vehicle 2 is colinear with the body vertical axis of vehicle 2.

Figure 6:
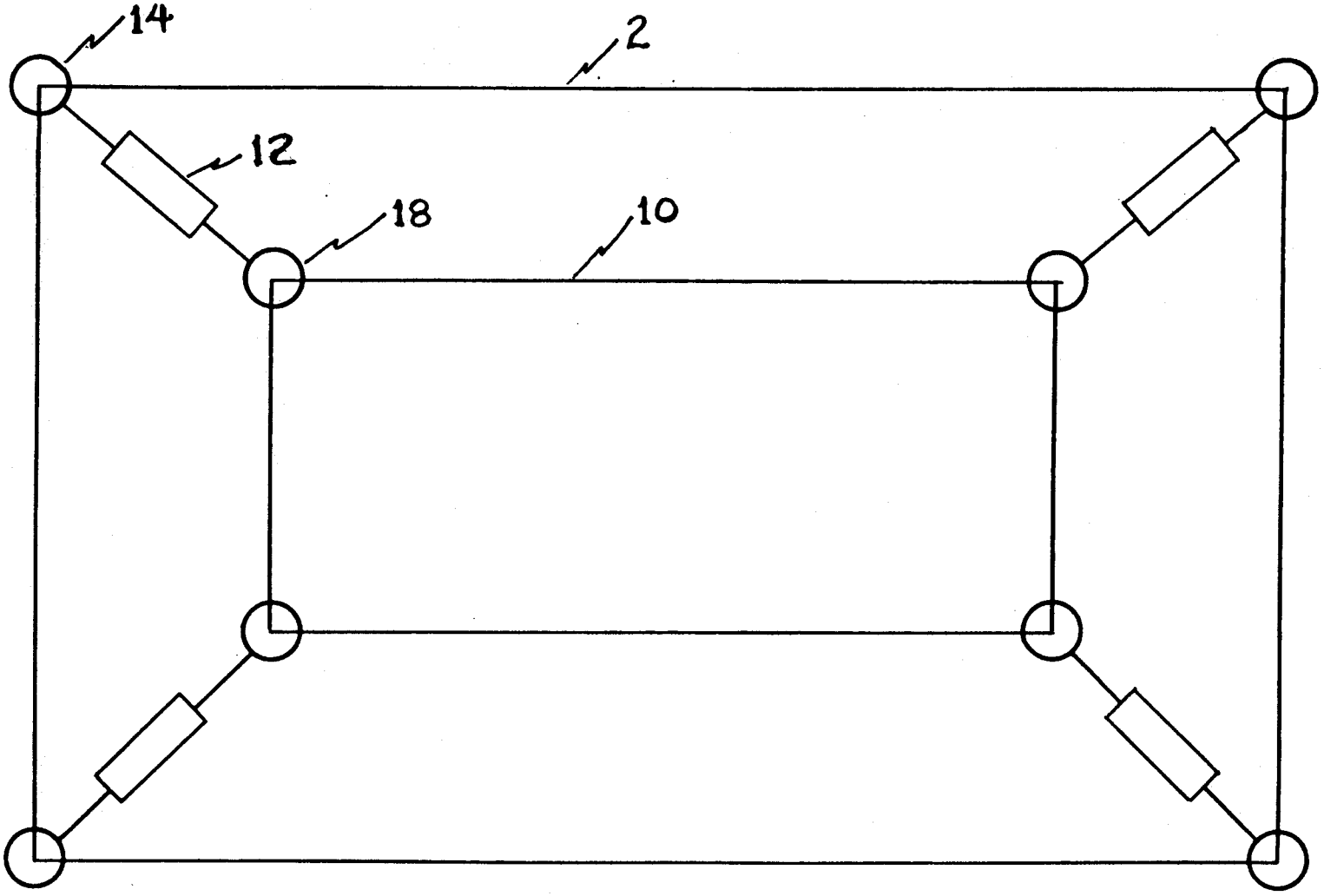
FIG. 6 is a plan view showing the passenger/cargo compartment coupled to the vehicular frame.

As shown in FIGS. 3 and 6, passenger/cargo compartment 10 is mounted to vehicle 2 by eight linear motors 12. The housing of each linear motor 12 is connected to vehicle 2 by universal joints 14, and the rod of each linear motor 12 is connected to compartment 10 by universal joint 18. A plan view of this mounting is shown in FIG. 6. The unbalancing of the displacements of the eight motors 12 positions compartment 10 relative to vehicle 2 so as to ensure that the vector sum of the centrifugal force on compartment 10, due to curvature of tunnel 1, and of the weight vector of compartment 10 is colinear with the body vertical axis of compartment 10.

Figure 7:
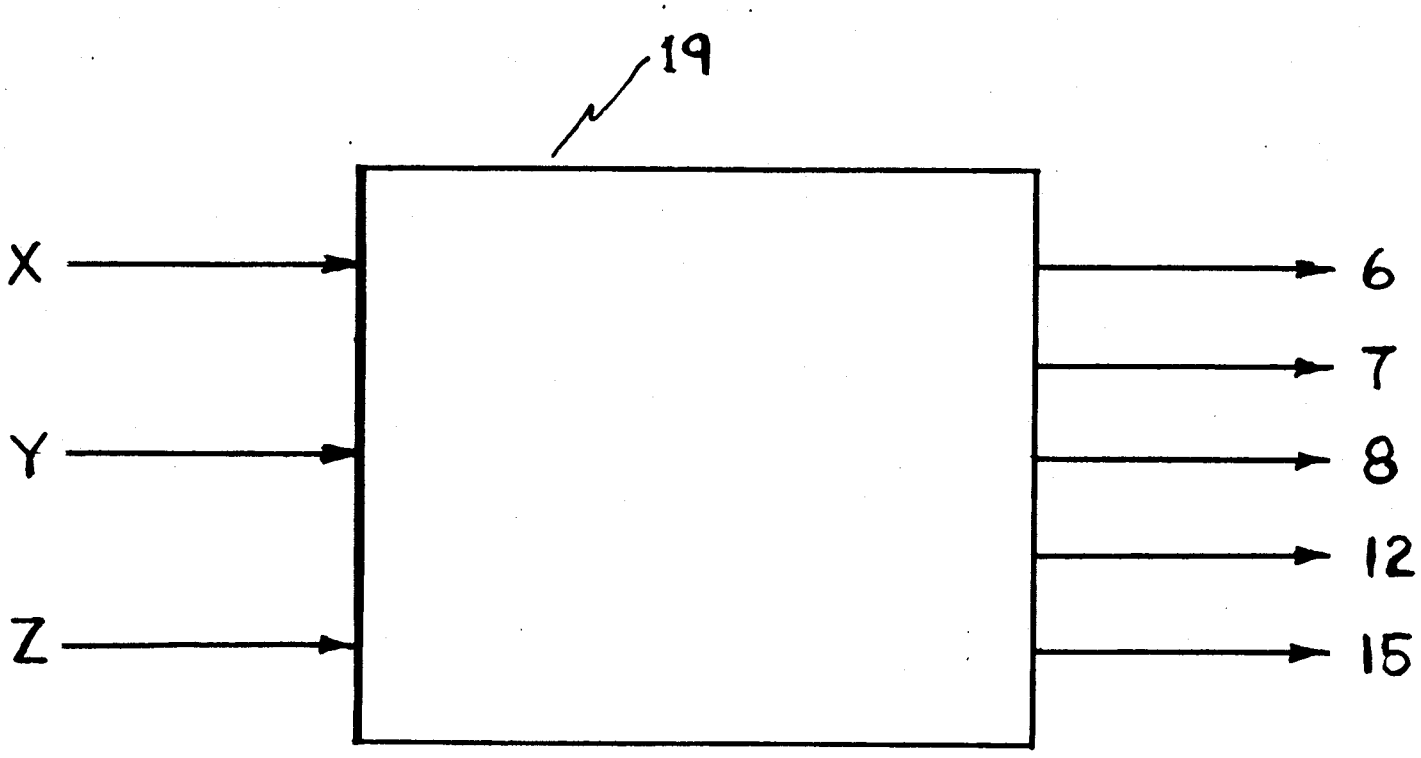
FIG. 7 is a diagram of the computerized process control subsystem.

The computerized process control subsystem 19, shown in FIG. 7, receives as inputs eight values X of the translational motion of sensor wheels 20 transmitted through link 22 to rotary sensor 21 mounted on vehicle 2. It also receives as an input the speed Y of the vehicle along tunnel 1. And it also receives as input the location Z of the vehicle along the arc of the longitudinal axis of tunnel 1. The system knows exactly where vehicle 2 is located at any time because of the positive traction in the system; therefore, knowing the entire space curve of the longitudinal axis of the tunnel, the system can anticipate any curvature in the tunnel. Solving an appropriate set of mathematical expressions, the computerized process control subsystem will determine, as functions of time, the rotation of each of rotary motors 6, rotary motors 7, and rotary motors 8, and also the linear motion of each of linear motors 12 and linear motors 15.

It is to be understood that while certain forms of the present invention have been illustrated and described herein, it is not to be limited to the specific forms and arrangements described and shown.

What is claimed and desired to be secured by Letters Patent is as follows:

1. A very high speed ground transportation system comprising one or more vehicles moving in a tunnel, wherein:
   (a) said tunnel has an interior helical surface with a helix axis colinear with the longitudinal axis of the tunnel;
   (b) each said vehicle is propelled by traction wheels mounted at each end of said vehicle spaced around the perimeter of said vehicle at a plurality of angular positions;
   (c) each said traction wheel is a helical gear meshing with said interior helical surface of said tunnel;
   (d) each said traction wheel is steerable;
   (e) each said traction wheel is split into a plurality of parallel planar traction wheel disks, each disk of said split wheel being rotatable relative to the other disk)s) about their common axis of spin; and
   (f) each vehicle supports a passenger/cargo compartment rotatable about all three body axes relative to said vehicle.

2. The system of claim 1 wherein:
   (a) said system contains means to steer said traction wheels; and
   (b) said system contains means to determine the steering rotation of each said traction wheel.

3. The system of claim 1 wherein:
   (a) said system contains means for the relative rotations of said disks of each said split traction wheel; and
   (b) said system contains means to determine the relative rotational motions of said disks of said split traction wheel.

4. The system of claim 1 wherein:
   (a) said system contains means for rotating said passenger/cargo compartment relative to said vehicle about all three body axes; and
   (b) said system contains means to determine the rotational motion of said compartment relative to said vehicle.

5. The system of claim 2 wherein:
   (a) said means to determine said steering rotation of each of said traction wheels is a computerized subsystem.

6. The system of claim 3 wherein:
   (a) said means to determine said relative rotational motions of said disks of said split traction wheel is a computerized subsystem.

7. The system of claim 4 wherein:
   (a) said means to determine the rotational motion of said compartment relative to said vehicle is a computerized subsystem.

* * * * *